US005283564A

United States Patent [19]

Katakura et al.

[11] Patent Number: 5,283,564

[45] Date of Patent: Feb. 1, 1994

[54] LIQUID CRYSTAL APPARATUS WITH TEMPERATURE-DEPENDENT PULSE MANIPULATION

[75] Inventors: Kazunori Katakura; Yoshio Hotta, both of Atsugi; Akira Tsuboyama, Sagamihara; Osamu Taniguchi, Chigasaki; Mitsuo Iwayama, Odawara; Tadashi Mihara, Kawasaki, all of Japan

[73] Assignee: Canon Kabushiki Kaisha, Tokyo, Japan

[21] Appl. No.: 813,498

[22] Filed: Dec. 26, 1991

[30] Foreign Application Priority Data

Dec. 26, 1990 [JP] Japan ..... 2-414049
Dec. 19, 1991 [JP] Japan ..... 3-336946

[51] Int. Cl.[5] ..... G09G 3/36

[52] U.S. Cl. ..... 345/87; 359/56; 345/94

[58] Field of Search ..... 340/784, 805, 802, 765; 359/56, 86; 358/236, 241

[56] References Cited

U.S. PATENT DOCUMENTS 4,655,561 4/1987 Kanbe et al. ..... 350/56
4,709,995 12/1987 Kuribayashi et al. ..... 350/56
4,800,382 1/1989 Okada et al. ..... 340/784
4,836,656 6/1989 Mouri et al. ..... 350/56
4,932,759 6/1990 Toyono et al. ..... 350/56
4,938,574 7/1990 Kaneko et al. ..... 350/56
4,952,032 8/1990 Inoue et al. ..... 359/86
5,048,934 9/1991 Numao ..... 359/55
5,058,994 10/1991 Mihara et al. ..... 359/56

FOREIGN PATENT DOCUMENTS 0281233 11/1990 Japan .

*Primary Examiner*—Alvin E. Oberley
*Assistant Examiner*—Chanh Nguyen
*Attorney, Agent, or Firm*—Fitzpatrick, Cella, Harper & Scinto

[57] ABSTRACT

Since a fluorescent lamp has a very wide temperature distribution, a large temperature non-uniformity also occurs on a display unit backlighted by the lamp. On the liquid crystal display, the ratio of pulses applied the information and scanning electrodes are controlled in accordance with the temperature change, the overcome the above problem. The ratio of a pulse peak value of a compensation phase part of a scanning selection signal to a pulse peak value of an auxiliary phase part of an information signal may be changed according to a change in temperature.

4 Claims, 7 Drawing Sheets

ERASING PHASE PART
V1
t1
COMPENSATION PHASE PART
V3
t3
SCANNING SELECTION SIGNAL 0
t2
CONTROL PHASE PART
-V2
V5
t2

0
t3
t3
(WHITE)
-V4
-V4
INFORMATION SIGNAL
AUXILIARY PHASE PART
V4
V4
(BLACK)

0
-V5
AUXILIARY PHASE PART
CONTROL PHASE PART

0
SCANNING NON-SELECTION SIGNAL

LIQUID CRYSTAL APPARATUS WITH TEMPERATURE-DEPENDENT PULSE MANIPULATION

BACKGROUND OF THE INVENTION

1. Field of the Invention

The present invention relates to a liquid crystal suitable for a display apparatus and, more particularly, to a liquid crystal apparatus using a ferroelectric liquid crystal.

2. Related Background Art

Conventionally, liquid crystal display elements are known. A liquid crystal display element is prepared by filling a liquid crystal compound between a scanning electrode group and a signal electrode group of matrix electrodes to form a large number of pixels, and to display image information. Of liquid crystal display elements, a ferroelectric liquid crystal element, which has bistability and a short response time to an electric field, functions as a high-speed, memory type display element. A large number of methods of matrix-driving the ferroelectric liquid crystal element have been proposed.

For example, practical drivers are disclosed in U.S. Pat. Nos. 4,655,561, 4,709,995, 4,800,382, 4,836,656 4,932,759, 4,938,574, 5,058,994, and the like.

In a conventional driver for a display panel using a ferroelectric liquid crystal, a problem associated with a change in temperature remains unsolved. In particular, when a displayed content on a display panel is to be observed, back light using a fluorescent lamp is used. Since the fluorescent lamp has a very wide temperature distribution, a large temperature nonuniformity also occurs on the display panel. For this reason, the display panel cannot often provide a satisfactory full display.

SUMMARY OF THE INVENTION

It is an object of the present invention to provide a liquid crystal apparatus, which can solve the conventional problems.

It is another object of the present invention to provide a liquid crystal apparatus, which can attain a good display even using a display panel suffering from a large temperature nonuniformity.

The present invention is characterized by a liquid crystal apparatus comprising:

a. matrix electrodes constituted by scanning electrodes and information electrodes;

b. information signal application means for applying, as an information signal, bipolar pulses to a liquid crystal through the information electrodes, the bipolar pulses having a control phase part determined by a pulse having one polarity or a pulse having the other polarity, and an auxiliary phase part determined by a pulse having a polarity opposite to the polarity of the pulse of the control phase part;

c. scanning signal application means for applying a scanning selection signal to the liquid crystal through the scanning electrodes, the scanning selection signal having an erasing phase part determined by a pulse having one polarity, a control phase part determined by a pulse having the other polarity, and synchronized with the control phase part of the information signal, and a compensation phase part synchronized with the auxiliary phase part of the information signal, and determined by a pulse having a polarity opposite to the pulse having the other polarity of the control phase part; and d. means for changing a ratio of a pulse peak value ($|V_3|$) of the compensation phase part of the scanning selection signal to a pulse peak value ($|\pm V_4|$) of the auxiliary phase part of the information signal according to a change in temperature.

In this specification, the polarity of a voltage to be applied to scanning and information electrodes is determined with reference to an application voltage to a scanning electrode, which is not scan-selected (a scan non-selection signal).

DETAILED DESCRIPTION OF THE PREFERRED EMBODIMENT

The present invention will now be described with reference to the accompanying drawings.

Figure 1:
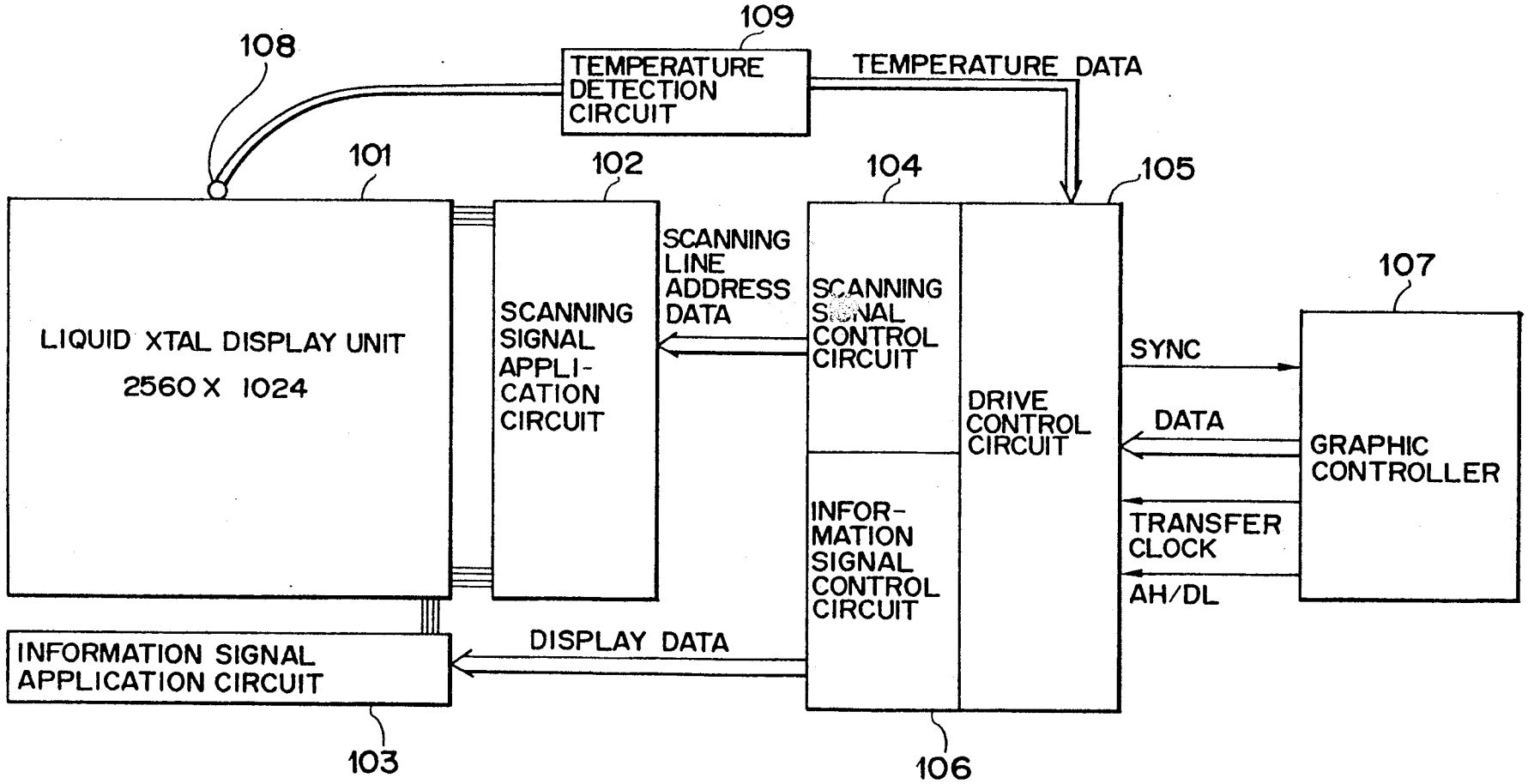
FIG. 1 is a block diagram of a liquid crystal apparatus according to the present invention.
Figure 7:
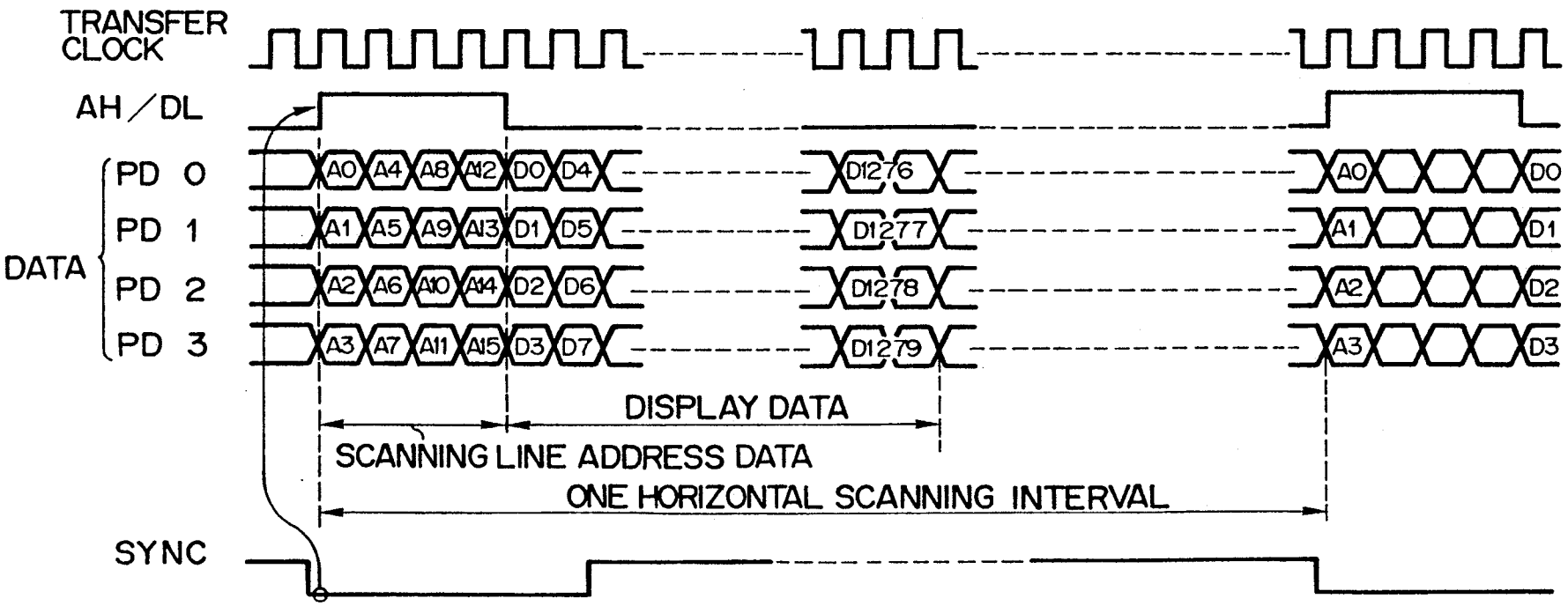
FIG. 7 is a timing chart of a communication used in the present invention.

FIG. 1 shows a liquid crystal apparatus according to one embodiment of the present invention. The liquid crystal apparatus comprises a liquid crystal display unit 101 having matrix electrodes constituted by scanning electrodes 201 and information electrodes 202 shown in FIG. 2, an information signal application circuit 103 for applying an information signal (FIGS. 4B and 4C) to a liquid crystal through the information electrodes 202, a scanning signal application circuit 102 for applying a scanning signal (FIG. 4A) to the liquid crystal through the scanning electrodes 201, a scanning signal control circuit 104, an information signal control circuit 106, a drive control circuit 105, a thermistor 108 for detecting the temperature of the display unit 101, and a temperature detection circuit 109 for detecting the temperature of the display unit 101 on the basis of the output from the thermistor 108. A ferroelectric liquid crystal is arranged between the scanning electrodes 201 and the information electrodes 202. A graphic controller 107 outputs data to the scanning signal control circuit 104 and the information signal control circuit 106 through the drive control circuit 105. The data input to the circuits 104 and 106 are respectively converted into address data and display data. The temperature of the liquid crystal display unit is input to the temperature detection circuit 109 through the thermistor 108, and is then input, as temperature data, to the scanning signal control circuit 104 through the drive control circuit 105. The scanning signal application circuit 102 generates a scanning signal according to address data and temperature data, and applies the scanning signal to the scanning electrodes 201 of the liquid crystal display unit 101. The information signal application circuit 103 generates an information signal according to display data, and applies the information signal to the information electrodes 202 of the liquid crystal display unit 101. FIG. 7 is a communication timing chart between the drive control circuit 105 and the graphic controller 107.

Figure 2:
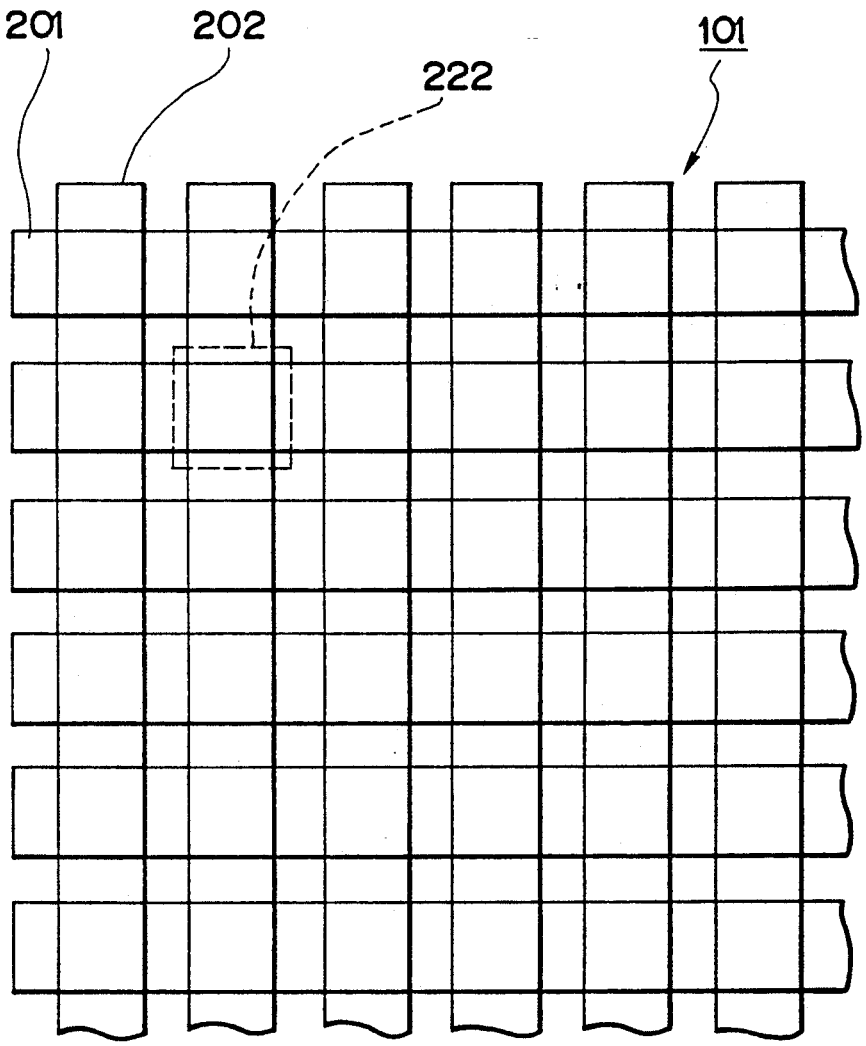
FIG. 2 is a plan view of matrix electrodes of a display panel used in the present invention.

In FIG. 2, each pixel 222 is constituted by a crossing portion between the scanning electrode 201 and the information electrode 202, and serves as one display unit. The scanning electrodes 201 and the information electrodes 202 constitute a matrix of pixels (matrix electrodes).

Figure 3:
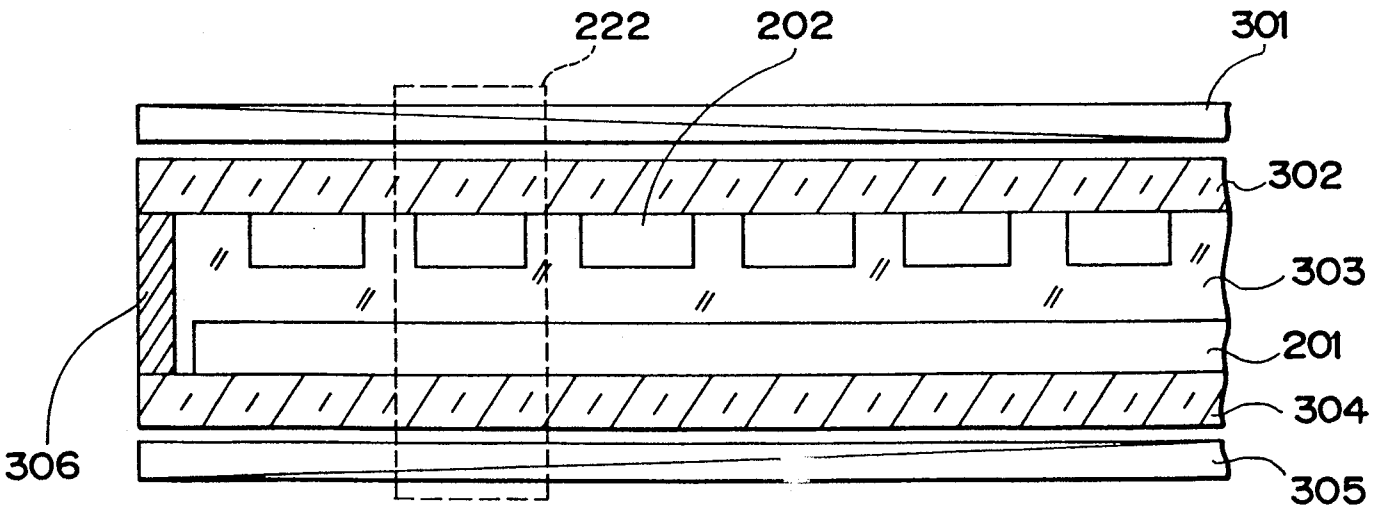
FIG. 3 is a sectional view of a liquid crystal cell used in the present invention.

FIG. 3 is a partial sectional view of the liquid crystal display unit 101. In FIG. 3, an analyzer 301 and a polarizer 305 are respectively arranged in a "crossed nicols" manner. The display unit 101 also comprises glass substrates 302 and 304, a ferroelectric liquid crystal 303, and a spacer 306.

Figures 4A, 4B, 4C, 4D:
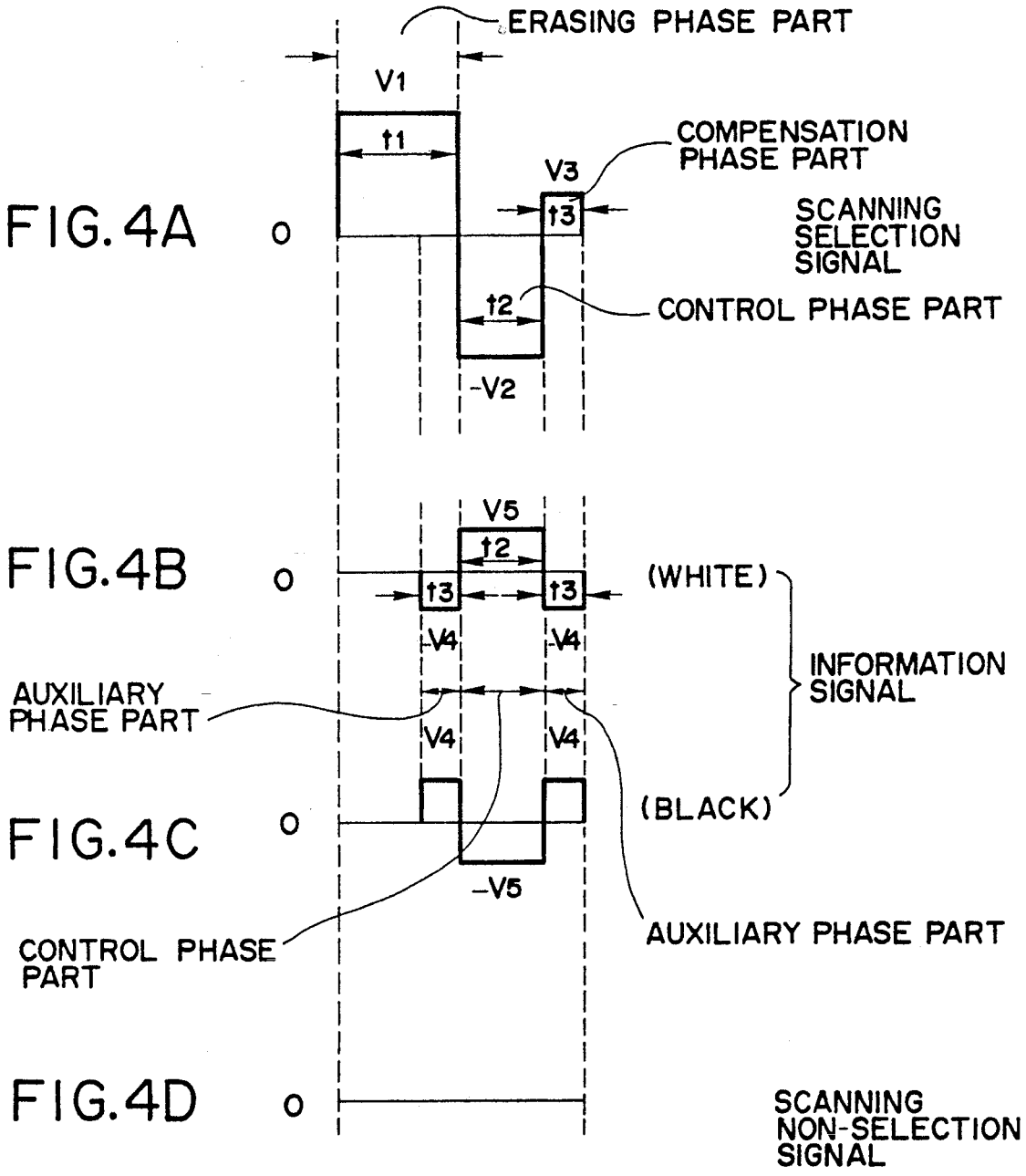
FIGS. 4A to 4D are waveform charts showing drive waveforms used in the present invention.

FIGS. 4A to 4D show waveforms of drive signals in the apparatus shown in FIG. 1. FIG. 4A shows a scanning selection signal waveform output from the scanning signal application circuit 102. FIGS. 4B and 4C show information signal waveforms corresponding to "white" and "black" display data output from the information signal application circuit 103. A phase having a pulse width t2 and a voltage value $\pm V_5$ in the waveform shown in FIG. 4B is a control phase (for example, when the voltage value is $V_5$, a white (W) state is formed; when it is $-V_5$, a black (B) state is formed). On the other hand, a phase having a pulse width t3 and a voltage value $\pm V_4$ in the waveform shown in FIG. 4B is an auxiliary phase (for example, $|\pm V_4| = |\pm V_5|$). A phase having a pulse width t1 and a voltage value $V_1$ in the waveform shown in FIG. 4A is an erasing phase part, a phase having a pulse width t2 and a voltage value $-V_2$ therein is a control phase, and a phase having a pulse width t3 and a voltage value $V_3$ therein is a compensation phase for compensating for an auxiliary phase, i.e., that of the information signal.

Figure 5:
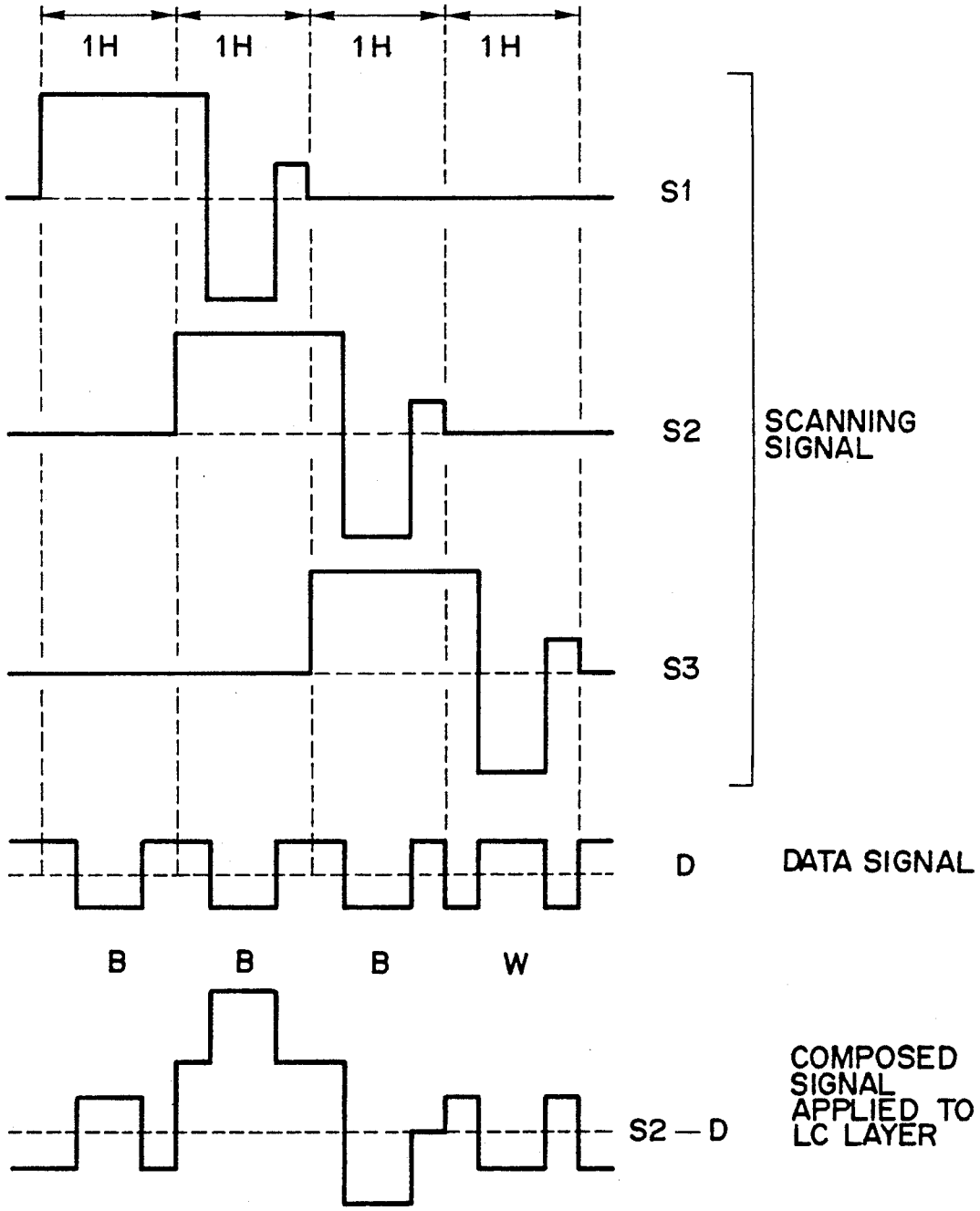
FIG. 5 is a timing chart when the drive waveforms shown in FIGS. 4A to 4D are used.

FIG. 5 is a timing chart when the drive waveforms shown in FIGS. 4A to 4D are used (1H in FIG. 5 represents one horizontal scanning interval).

Since the compensation phase part is provided to the scanning selection signal, the range of a temperature margin (to be described below) can be widened. According to the present invention, the temperature margin can be further improved.

Figure 6:
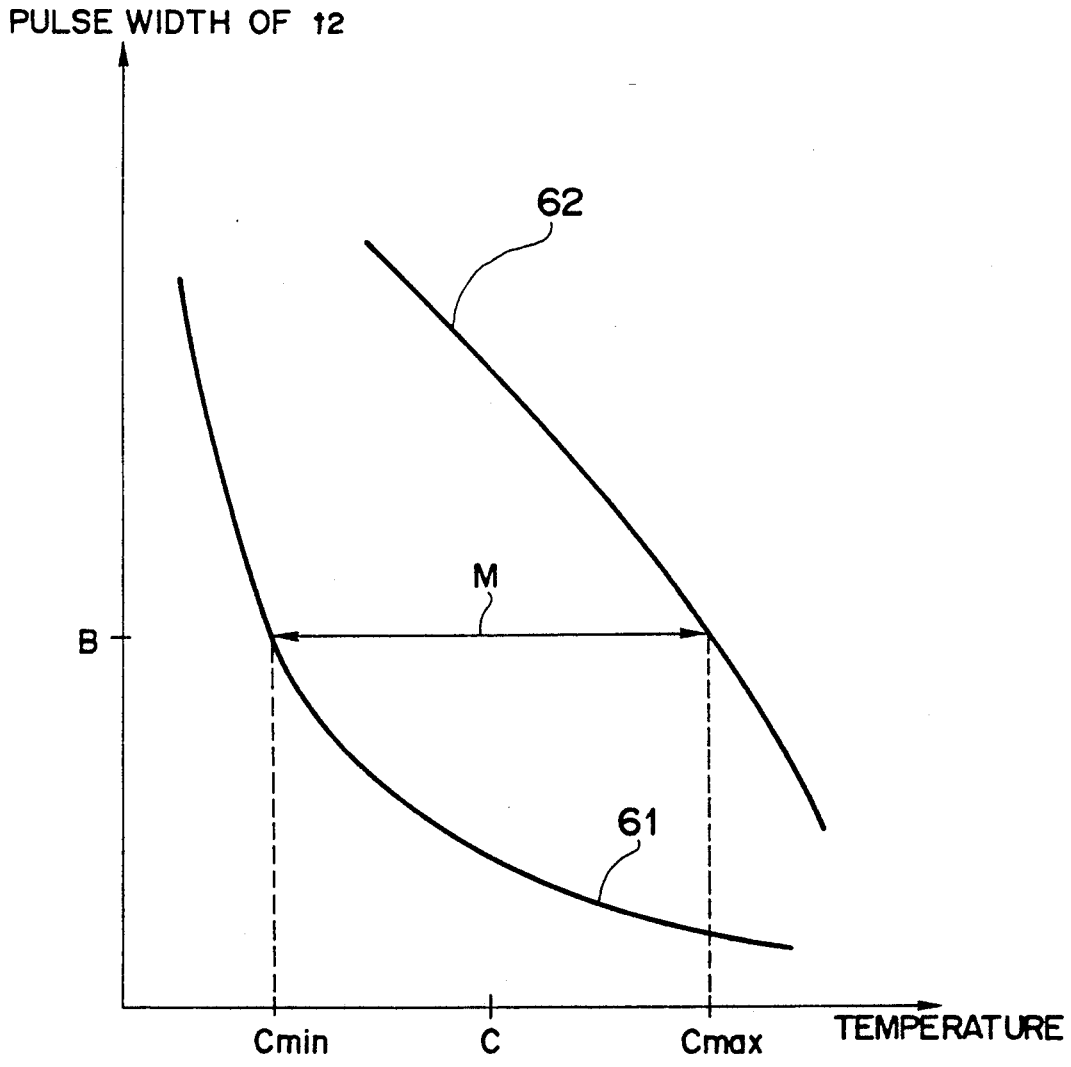
FIG. 6 is a graph showing temperature margin characteristics.

FIG. 6 shows temperature margin characteristics of a cell having a cell thickness of 1.5 μm when a pyrimidine-based chiral smectic C liquid crystal having phase transfer characteristics (to be described below) is used (the voltage value is constant). In FIG. 6, a curve 61 represents threshold curve characteristics (indicating a pulse width (t2) with which a pixel on the scanning-selected scanning electrode can be reversed from white to black or vice versa). A curve 62 represents crosstalk curve characteristics (indicating a pulse width capable of holding a write state when a pixel applied with a scanning non-selection signal is scanning-selected). When the pulse width=B, a maximum temperature margin M can be given. C represents the central temperature of the temperature margin M.

$$\text{Cry} \underset{-11.6^\circ\text{ C.}}{\overset{-11.3^\circ\text{ C.}}{\rightleftarrows}} \text{Sm*C} \underset{71.5^\circ\text{ C.}}{\overset{72.2^\circ\text{ C.}}{\rightleftarrows}} \text{SmA} \underset{76.6^\circ\text{ C.}}{\overset{76.9^\circ\text{ C.}}{\rightleftarrows}} \text{Ch} \underset{84.5^\circ\text{ C.}}{\overset{82.9^\circ\text{ C.}}{\rightleftarrows}} I_{SO}$$

(Cry: Crystal Phase
Sm*C: Chiral Smectic C Phase
SmA: Smectic A Phase
Ch: Cholesteric Phase
$I_{SO}$: Isotropic Phase)

Spontaneous Polarization: 11.6 nc/cm$^2$ (at 30° C.)

According to the temperature margin characteristics shown in FIG. 6, even when a temperature nonuniformity occurs, i.e., a portion having a minimum temperature $C_{min}$ and a portion having a maximum temperature $C_{max}$ is formed in the display panel, if the display panel is driven with the pulse width t2 =B, a uniform display can be attained over the entire display screen. Therefore, it is convenient as the difference between the minimum and maximum temperatures $C_{min}$ and $C_{max}$ is larger.

Tables below show the measurement results of the temperature margin M when the drive waveforms shown in FIGS. 4A to 5 are set under drive conditions I and II. Table 1 shows the results under the drive condition I, and Table 2 shows the results under the drive condition II.

Drive I:

$$|V_3|/|\pm V_4| = 1.1$$

$V_1 = 13.8$ V
$V_2 = 13.8$ V
$V_3 = 7.0$ V
$V_4 = 6.3$ V
$V_5 = 6.3$ V t1=(3/2)t2 t3=(1/2)t2

Drive Condition II:

$$|V_3|/|\pm V_4| = 1.5$$

$V_1 = 13.8$ V
$V_2 = 13.8$ V
$V_3 = 9.2$ V
$V_4 = 6.3$ V
$V_5 = 6.3$ V t1=(3/2)t2 t3=(1/2)t2

TABLE 1

(Drive I)

| Central Temperature | 15° C. | 20° C. | 25° C. | 30° C. | 35° C. |
|---|---|---|---|---|---|
| t2 (μsec) | 172.5 | 132 | 108 | 91.5 | 76.5 |
| Temperature Margin (°C.) | 15 ± 3.4 | 20 ± 3.8 | 25 ± 3.9 | 30 ± 3.7 | 35 ± 3.4 |

TABLE 2

(Drive II)

| Central Temperature | 15° C. | 20° C. | 25° C. | 30° C. | 35° C. |
|---|---|---|---|---|---|
| t2 (μsec) | 180 | 138 | 111 | 94.5 | 79.5 |
| Temperature Margin | 15 ± 3.2 | 20 ± 3.2 | 25 ± 4.1 | 30 ± 4.5 | 35 ± 4.9 |

TABLE 2-continued

| Central Temperature (°C.) | (Drive II) 15° C. | 20° C. | 25° C. | 30° C. | 35° C. |
|---|---|---|---|---|---|

For example, the temperature margin in the above tables falls within the range between 11.6° C. and 18.4° C. at the central temperature of 15° C. in Table 1.

According to this embodiment, when the central temperature fell within the range between 15° C. and 20° C., $|V_3|/|\pm V_4|$ was set to be 1.1, and when the central temperature fell within the range between 25° C. and 35° C., $|V_3|/|\pm V_4|$ was set to be 1.5. Thus, when there was a temperature nonuniformity of a minimum of 6.8° C., a uniform display could be made on the display screen within the temperature range between 15° C. and 35° C.

In contrast to this, when the central temperature was 25° C., and the value of $|V_3|/|\pm V_4|$ was set to be a constant value, e.g., 1.1 regardless of a decrease in temperature, a display was partially disabled on the display screen within the central temperature range between 15° C. and 20° C.

According to the present invention, it is preferable that $|V_3|/|\pm V_4|$ is set to fall within a range between 0.7 and 1.77. When this ratio falls outside this range, the effect of the compensation pulse is impaired.

According to the present invention, since the value of $|V_3|/|\pm V_4|$ was increased according to a temperature rise, a uniform display could be made over the entire display screen (especially, in a large screen panel of 14" or larger) over a wide use temperature range, and over a wide temperature nonuniformity range in the display panel.

What is claimed is:

1. A liquid crystal apparatus comprising:

a. matrix electrodes including scanning electrodes and information electrodes;

b. information signal application means for applying, as an information signal, bipolar pulses to a liquid crystal through said information electrodes, said bipolar pulses having a control phase part determined by a pulse having one polarity or a pulse having the other polarity, and an auxiliary phase part determined by a pulse having a polarity opposite to the polarity of the pulse of the control phase part;

c. scanning signal application means for applying a scanning selection signal to the liquid crystal through said scanning electrodes, said scanning selection signal having an erasing phase part determined by a pulse having one polarity, a control phase part determined by a pulse having the other polarity, and synchronized with the control phase part of the information signal, and a compensation phase part synchronized with the auxiliary phase part of the information signal, and determined by a pulse having a polarity opposite to the pulse having the other polarity of the control phase part of the scanning selection signal; and d. means for changing a ratio of a pulse peak value ($|V_3|$) of the compensation phase part of the scanning selection signal to a pulse peak value ($|V_4|$) of the auxiliary phase part of the information signal according to a change in temperature.

2. An apparatus according to claim 1, wherein $|V_3|/|\pm V_4|$ changes within a range between 0.7 and 1.7.

3. An apparatus according to claim 1, wherein $|V_3|/|\pm V_4|$ is increased according to a temperature rise.

4. An apparatus according to claim 1, wherein the liquid crystal comprises a ferroelectric liquid crystal.

* * * * *

UNITED STATES PATENT AND TRADEMARK OFFICE

CERTIFICATE OF CORRECTION

PATENT NO. : 5,283,564

DATED : February 1, 1994

INVENTOR(S) : KAZUNORI KATAKURA ET AL

It is certified that error appears in the above-indentified patent and that said Letters Patent is hereby corrected as shown below:

AT [57] ABSTRACT

Line 4, "applied" should read --applied to--.
Line 6, "the overcome" should read --to overcome--.

COLUMN 1

Line 27, "4,836,656" should read --4,836,656,--.
Line 45, "a large" should read --large--.

Signed and Sealed this

Sixth Day of September, 1994

Bruce Lehman

*Attest:*

BRUCE LEHMAN

*Attesting Officer*

*Commissioner of Patents and Trademarks*